US008029957B2

(12) United States Patent
Hu et al.

(10) Patent No.: US 8,029,957 B2
(45) Date of Patent: Oct. 4, 2011

(54) PHOTORECEPTOR WITH OVERCOAT LAYER

(75) Inventors: Nan-Xing Hu, Oakville (CA); Kathy L. De Jong, Mississauga (CA); Hany Aziz, Oakville (CA)

(73) Assignee: Xerox Corporation, Norwalk, CT (US)

( * ) Notice: Subject to any disclaimer, the term of this patent is extended or adjusted under 35 U.S.C. 154(b) by 1525 days.

(21) Appl. No.: 11/421,650

(22) Filed: Jun. 1, 2006

(65) Prior Publication Data

US 2007/0281228 A1 Dec. 6, 2007

(51) Int. Cl.
*G03G 5/147* (2006.01)

(52) U.S. Cl. ..... 430/58.7; 430/66; 430/132; 430/133

(58) Field of Classification Search ..... 430/58.7, 430/66, 132, 133
See application file for complete search history.

(56) References Cited

U.S. PATENT DOCUMENTS

| | | | | |
|---|---|---|---|---|
| 3,121,006 | A | 2/1964 | Middleton et al. | |
| 4,125,678 | A * | 11/1978 | Stvan et al. | 428/514 |
| 4,286,033 | A | 8/1981 | Neyhart et al. | |
| 4,291,110 | A | 9/1981 | Lee | |
| 4,298,697 | A | 11/1981 | Baczek et al. | |
| 4,338,387 | A | 7/1982 | Hewitt | |
| 4,338,390 | A | 7/1982 | Lu | |
| 4,457,994 | A | 7/1984 | Pai et al. | |
| 4,560,635 | A | 12/1985 | Hoffend et al. | |
| 4,654,284 | A | 3/1987 | Yu et al. | |
| 4,871,634 | A | 10/1989 | Limburg et al. | |
| 5,059,639 | A * | 10/1991 | Ohkura et al. | 523/205 |
| 5,324,788 | A * | 6/1994 | Kuo | 525/329.5 |
| 5,368,967 | A | 11/1994 | Schank et al. | |
| 5,399,452 | A * | 3/1995 | Takegawa et al. | 430/59.6 |
| 5,418,107 | A | 5/1995 | Nealey et al. | |
| 5,681,679 | A | 10/1997 | Schank et al. | |
| 5,702,854 | A | 12/1997 | Schank et al. | |
| 5,709,974 | A | 1/1998 | Yuh et al. | |
| 5,976,744 | A | 11/1999 | Fuller et al. | |
| 6,004,709 | A | 12/1999 | Renfer et al. | |
| 6,261,729 | B1 | 7/2001 | Yuh et al. | |
| 6,287,246 | B1 * | 9/2001 | Yoshii et al. | 492/59 |
| 6,756,169 | B2 | 6/2004 | Lin et al. | |
| 6,946,226 | B2 | 9/2005 | Wu et al. | |
| 6,946,227 | B2 | 9/2005 | Lin et al. | |
| 7,759,032 | B2 * | 7/2010 | Yanus et al. | 430/66 |
| 2003/0129512 | A1 * | 7/2003 | Sugino et al. | 430/66 |
| 2003/0194625 | A1 * | 10/2003 | Tanaka et al. | 430/58.8 |
| 2004/0101774 | A1 * | 5/2004 | Yoshimura et al. | 430/66 |
| 2005/0202348 | A1 * | 9/2005 | Nakayama et al. | 430/311 |
| 2006/0029871 | A1 * | 2/2006 | Hu et al. | 430/58.7 |
| 2006/0216619 | A1 * | 9/2006 | Iwasaki et al. | 430/58.75 |
| 2007/0166634 | A1 * | 7/2007 | Qi et al. | 430/58.7 |
| 2007/0281228 | A1 * | 12/2007 | Hu et al. | 430/58.7 |

OTHER PUBLICATIONS

U.S. Appl. No. 11/234,275, Dinh et al., filed Sep. 26, 2005.
U.S. Appl. No. 11/275,546, Qi et al., filed Jan. 13, 2006.
Product List, Basic Chemicals/Functional Chemicals, Nippon Shokubai, 2000, p. 12, Japan.
Cytec, Can Coating Conventional and UV Resins and Additives for Can Coating, pp. 16-17, (2008).
Cymel® 1123 From Cytec, Http://www.specialchem4coatings.com/tds/cyme1-1123/cytec/279/index.aspx (2010 web page).

* cited by examiner

*Primary Examiner* — Christopher Rodee
*Assistant Examiner* — Rachel Zhang
(74) *Attorney, Agent, or Firm* — Oliff & Berridge, PLC

(57) ABSTRACT

An electrophotographic imaging member includes a substrate, a charge generating layer, a charge transport layer, and an overcoating layer, the overcoating layer being a cured film formed from a composition including at least a hydroxyl group-containing polymer or oligomer, a benzoguanamine compound containing at least one —$CH_2OR$ group, wherein each such R is independently an H atom or an alkyl group having from 1 to about 20 carbon atoms, and a charge transport compound.

14 Claims, No Drawings

PHOTORECEPTOR WITH OVERCOAT LAYER

TECHNICAL FIELD

This disclosure is generally directed to electrophotographic imaging members and, more specifically, to layered photoreceptor structures with an improved overcoat layer. In particular, this disclosure relates to electrophotographic imaging members with an improved overcoat layer comprising a crosslinked product derived from a hydrophobic curing agent, a hydroxyl group-containing component and a charge transporting molecule. This disclosure also relates to processes for making and using the imaging members.

An advantage associated with the electrophotographic imaging members described herein is that by use of the hydrophobic curing agent, the imaging member achieves not only wear resistance, but also water resistance so that the imaging member is able to avoid image deletions in a broad range of humidity environments.

The photoconductive members described herein may be used in, for example, electrophotographic imaging devices and xerographic imaging devices, printing processes, color imaging processes, copying/printing/scanning/fax combination systems and the like. The photoconductive member may be, for example, a photoreceptor, and may have any suitable form, for example plate, belt or drum form.

RELATED APPLICATIONS

Copending U.S. patent application Ser. No. 11/234,275, filed Sep. 26, 2005, discloses an electrophotographic imaging member comprising: a substrate, a charge generating layer, a charge transport layer, and an overcoating layer, the overcoating layer comprising a cured polyester polyol or cured acrylated polyol film forming resin and a charge transport material.

Copending U.S. patent application Ser. No. 11/275,546, filed Jan. 13, 2006, discloses an electrophotographic imaging member comprising: a substrate, a charge generating layer, a charge transport layer, and an overcoating layer, the overcoating layer comprising a cured film formed from a film forming resin composition comprising at least a melamine compound, a polyol and a charge transport compound, wherein the charge transport compound is represented by $$Q\text{—}[L\text{—}OH]_n$$

wherein Q represents a charge transport component, L represents a divalent linkage group, and n represents a number of repeating segments or groups.

The appropriate components and process aspects of the foregoing, such as the imaging member composition, components and methods, may be selected for the present disclosure in embodiments thereof. The entire disclosures of the above-mentioned applications are totally incorporated herein by reference.

REFERENCES

Various overcoats employing alcohol soluble polyamides have been proposed in the art. One of the earliest such overcoats is an overcoat comprising an alcohol soluble polyamide without any methyl methoxy groups (ELVAMIDE) containing N,N'-diphenyl-N,N'-bis(3-hydroxyphenyl)-[1,1'-biphenyl]-4,4'-diamine. This overcoat is described in U.S. Pat. No. 5,368,967, the entire disclosure thereof being incorporated herein by reference. U.S. Pat. No. 5,368,967 discloses an electrophotographic imaging member comprising a substrate, a charge generating layer, a charge transport layer, and an overcoat layer comprising a small molecule charge transporting arylamine having at least two hydroxy functional groups, a hydroxy or multihydroxy triphenyl methane, and a polyamide film forming binder capable of forming hydrogen bonds with the hydroxy functional groups such as the hydroxy arylamine and hydroxy or multihydroxy triphenyl methane. This overcoat layer may be fabricated using an alcohol solvent. Specific materials including ELVAMIDE® polyamide, N,N'-diphenyl-N,N'-bis(3-hydroxyphenyl)-(1,1'-biphenyl)-4,4'-diamine and bis-[2-methyl-4-(N-2-hydroxyethyl-N-ethyl-aminophenyl)]-phenylmethane are disclosed in this patent.

A crosslinked polyamide overcoat is known, comprising a crosslinked polyamide containing N,N'-diphenyl-N,N'-bis(3-hydroxyphenyl)-(1,1'-biphenyl)-4,4'-diamine, and referred to as LUCKAMIDE®. In order to achieve crosslinking, a polyamide polymer having N-methoxymethyl groups (LUCKAMIDE®) was employed along with a catalyst such as oxalic acid. This overcoat is described in U.S. Pat. No. 5,702,854, the entire disclosure thereof being incorporated herein by reference.

U.S. Pat. No. 5,976,744 discloses an electrophotographic imaging member including a supporting substrate coated with at least one photoconductive layer and an overcoating layer. The overcoating layer includes hydroxy functionalized aromatic diamine and a hydroxy functionalized triarylamine dissolved or molecularly dispersed in a crosslinked acrylated polyamide matrix. The hydroxy functionalized triarylamine is a compound different from the polyhydroxy functionalized aromatic diamine.

U.S. Pat. No. 5,709,974 discloses an electrophotographic imaging member including a charge generating layer, a charge transport layer and an overcoating layer, the transport layer including a charge transporting aromatic diamine molecule in a polystyrene matrix and the overcoating layer including a hole transporting hydroxy arylamine compound having at least two hydroxy functional groups and a polyamide film forming binder capable of forming hydrogen bonds with the hydroxy functional groups of the hydroxy arylamine compound.

U.S. Pat. No. 5,681,679 discloses a flexible electrophotographic imaging member including a supporting substrate and a resilient combination of at least one photoconductive layer and an overcoating layer, the at least one photoconductive layer comprising a hole transporting arylamine siloxane polymer and the overcoating layer comprising a crosslinked polyamide doped with a dihydroxy amine.

U.S. Pat. No. 6,004,709 discloses an allyloxypolyamide composition, the allyloxypolyamide being represented by a specific formula. The allyloxypolyamide may be synthesized by reacting an alcohol soluble polyamide with formaldehyde and an allylalcohol. The allyloxypolyamide may be crosslinked by a process selected from the group consisting of (a) heating an allyloxypolyamide in the presence of a free radical catalyst, and (b) hydrosilation of the double bond of the allyloxy group of the allyloxypolyamide with a silicon hydride reactant having at least two reactive sites. A photoreceptor may comprise a substrate, at least one photoconductive layer, and an overcoat layer comprising a hole transporting hydroxy arylamine compound having at least two hydroxy functional groups, and the crosslinked allyloxypolyamide film forming binder.

U.S. Pat. No. 4,871,634 discloses an electrostatographic imaging member which contains at least one electrophotoconductive layer, the imaging member comprising a photogenerating material and a hydroxy arylamine compound represented by a certain formula. The hydroxy arylamine compound can be used in an overcoating with the hydroxy arylamine compound bonded to a resin capable of hydrogen bonding such as a polyamide possessing alcohol solubility.

U.S. Pat. No. 4,457,994 discloses a layered photosensitive member comprising a generator layer and a transport layer containing a diamine type molecule dispersed in a polymeric binder and an overcoat containing triphenyl methane molecules dispersed in a polymeric binder.

U.S. Pat. No. 5,418,107 discloses a process for fabricating an electrophotographic imaging member including providing a substrate to be coated, forming a coating comprising photoconductive pigment particles having an average particle size of less than about 0.6 micrometer dispersed in a solution of a solvent comprising n-alkyl acetate having from 3 to 5 carbon atoms in the alkyl group and a film forming polymer consisting essentially of a film forming polymer having a polyvinyl butyral content between about 50 and about 75 mol percent, a polyvinyl alcohol content between about 12 and about 50 mol percent, and a polyvinyl acetate content is between about 0 to 15 mol percent, the photoconductive pigment particles including a mixture of at least two different phthalocyanine pigment particles free of vanadyl phthalocyanine pigment particles, drying the coating to remove substantially all of the alkyl acetate solvent to form a dried charge generation layer comprising between about 50 percent and about 90 percent by weight of the pigment particles based on the total weight of the dried charge generation layer, and forming a charge transport layer.

The disclosures of each of the foregoing patents are hereby incorporated by reference herein in their entireties. The appropriate components and process aspects of the each of the foregoing patents may also be selected for the present compositions and processes in embodiments thereof.

BACKGROUND

Photosensitive members such as electrophotographic or photoconductive members, including photoreceptors or photoconductors, typically include a photoconductive layer formed on, for example, an electrically conductive substrate or formed on layers between the substrate and photoconductive layer. The photoconductive layer is an insulator in the dark so that electric charges are retained on its surface. Upon exposure to light, the charge is dissipated. In this manner, an image, for example a latent image, can be formed on the photoreceptor, developed using a developer material such as toner, transferred to an image receiving substrate such as paper, and fused thereto to form a copy or print.

As noted in several of the patents discussed in the above discussion, a significant property in photoreceptors is wear resistance, and improved wear resistance is always being sought. For example, advanced imaging systems are based on the use of small diameter photoreceptor drums, and the use of small diameter drums places a premium on photoreceptor life. Small diameter drum photoreceptors are particularly susceptible to wear because about 3 to 10 revolutions of the drum may be required to image a single letter size page. Multiple revolutions of a small diameter drum photoreceptor to reproduce a single letter size page can thus require about 1 million cycles or more from the photoreceptor drum to obtain 100,000 prints, a desirable print job goal for commercial systems.

For low volume copiers and printers, bias charging rolls (BCR) are desirable because little or no ozone is produced during image cycling. However, the microcorona generated by the BCR during charging damages the photoreceptor, resulting in rapid wear of the imaging surface, for example, the exposed surface of the charge transport layer. More specifically, wear rates can be as high as about 10 microns per 100,000 imaging cycles. Similar problems are encountered with bias transfer roll (BTR) systems and belt systems. One approach to achieving longer photoreceptor drum life is to form a protective overcoat on the imaging surface, for example on the charge transporting layer of a photoreceptor. This overcoat layer must satisfy many requirements, including transporting holes, resisting image deletion, resisting wear, avoidance of perturbation of underlying layers during coating.

Despite the various approaches that have been taken for forming overcoating layers, there remains a need for improved overcoat layer design, to provide increased wear resistance as well as resistance to moisture such as humidity and the like. Achieving these properties can increase the useful life of the photoreceptor and/or increase the range of environments and printing apparatus in which the photoreceptor can be used.

SUMMARY

In embodiments, described is an electrophotographic imaging member having an overcoat layer, the overcoat layer comprising a cured film formed from a composition comprising at least a hydroxyl group-containing polymer or oligomer, a benzoguanamine compound containing at least one —$CH_2OR$ group, wherein each such R is independently an H atom or an alkyl group having from 1 to about 20 carbon atoms, and a charge transport compound.

In further embodiments, described is an electrophotographic imaging member comprising a substrate, a charge generating layer, a charge transport layer, and an overcoat layer, the overcoat layer comprising a cured film formed from a composition comprising at least a hydroxyl group-containing polymer, a benzoguanamine compound containing at least one —$CH_2OR$ group, wherein each such R is independently an HE atom or an alkyl group having from 1 to about 20 carbon atoms, and a charge transport compound.

In still further embodiments, described is a process for forming an electrophotographic imaging member comprising providing an electrophotographic imaging member comprising a substrate, a charge generating layer, and a charge transport layer, coating thereover an overcoat a composition comprising at least a hydroxyl group-containing polymer, a benzoguanamine compound containing at least one —$CH_2OR$ group, wherein each such R is independently an H atom or an alkyl group having from 1 to about 20 carbon atoms, a charge transport compound, and an acid catalyst, followed by curing the overcoat at a temperature ranging from about 80° C. to about 160° C.

The imaging member with the overcoating layer described herein may be used in forming an image with an imaging device, for example such as a xerographic device.

EMBODIMENTS

Electrophotographic imaging members or photoreceptors are known in the art. Electrophotographic imaging members may be prepared by any suitable technique. Typically, a flexible or rigid substrate, for example in belt, plate or roll form, is provided with an electrically conductive surface. A charge generating layer is then applied to the electrically conductive surface. A charge blocking layer may optionally be applied to the electrically conductive surface prior to the application of a charge generating layer. If desired, an adhesive layer may be utilized between the charge blocking layer and the charge generating layer. Usually the charge generation layer is applied onto the blocking layer and a charge transport layer is formed on the charge generation layer. This structure may have the charge generation layer on top of or below the charge transport layer, or the charge transport and charge generating layers may comprise a same single layer.

The imaging members thus are, in embodiments, multilayered photoreceptors that comprise at least a substrate, an optional conductive layer, an optional undercoat layer, an optional adhesive layer, a charge generating layer, a charge transport layer, and an overcoat layer.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, and the like which are flexible as tin webs or films. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, drum or roll, a plate or sheet and the like. The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photoresponsive imaging device, the thickness of the conductive coating may be about 20 angstroms to about 750 angstroms, such as about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique, electrodeposition, solution coating, vapor deposition, sputtering and the like. Typical metals include aluminum, zirconium, niobium, tantalum, indium, vanadium, hafnium, titanium, nickel, stainless steel, chromium, tungsten, molybdenum, copper and the like. The thickness of the conductive layer is, in one embodiment, from about 20 angstroms to about 750 angstroms, and, in another from about 50 angstroms to about 200 angstroms, for a suitable combination of electrical conductivity, flexibility, and light transmission.

If a conductive layer is used, it is positioned over the substrate. The term "over" as used herein in connection with many different types of layers, as well as the term "under," should be understood as not being limited to instances where the specified layers are contiguous. Rather, the term refers to relative placement of the layers and encompasses the inclusion of unspecified intermediate layers, for example such as adhesive layers or other layers, between the specified layers.

Specific illustrative examples of substrate layers selected for the photoconductive imaging members include a layer of insulating material, for example including inorganic or organic polymeric materials, such as MYLAR®, a commercially available polymer, MYLAR® containing titanium, a layer of an organic or inorganic material having a semiconductive surface layer, such as indium tin oxide or aluminum arranged thereon, or a conductive material inclusive of aluminum, chromium, nickel, brass and the like.

In some situations, it may be desirable to coat on the back of the substrate, particularly when the substrate is a flexible organic polymeric material, an anticurl layer, such as polycarbonate materials commercially available as MAKROLON®. An example of an anticurl backing layer is described in U.S. Pat. No. 4,654,284, the entire disclosure of which is incorporated herein by reference. A thickness from about 70 to about 160 micrometers for the anticurl layer may be a satisfactory range for flexible photoreceptors.

An optional hole blocking layer may be applied over the substrate. Any suitable and conventional blocking layer capable of forming an electronic barrier to holes between the adjacent photoconductive layer and the underlying conductive surface of a substrate may be utilized. If a hole blocking layer is employed, it is thus positioned over the substrate but under the charge generating layer.

A suitable hole blocking layer may be comprised of polymers such as polyvinyl butyral, epoxy resins, polyesters, polysiloxanes, polyamides, polyurethanes, and the like, nitrogen-containing siloxanes or nitrogen-containing titanium compounds, such as trimethoxysilyl propyl ethylene diamine, N-beta(aminoethyl)gamma-aminopropyl trimethoxy silane, isopropyl 4-aminobenzene sulfonyl titanate, di(dodecylbenezene sulfonyl)titanate, isopropyl di(4-aminobenzoyl)isostearoyl titanate, isopropyl tri(N-ethyl amino)titanate, isopropyl trianthranil titanate, isopropyl tri(N,N-dimethyl-ethyl amino)titanate, titanium-4-amino benzene sulfonate oxyacetate, titanium 4-aminobenzoate isostearate oxyacetate, gamma-aminobutyl methyl dimethoxy silane, gamma-aminopropyl methyl dimethoxy silane, and gamma-aminopropyl trimethoxy silane, for example as disclosed in U.S. Pat. Nos. 4,338,387, 4,286,033 and 4,291,110, each incorporated herein by reference in its entirety. A suitable hole blocking layer may also be comprised of a polymer composite composition comprising n-type metal oxide particles, for example as disclosed in U.S. Pat. Nos. 6,261,729 and 6,946,226, each incorporated herein by reference in its entirety.

The hole blocking layer may be applied as a coating by any suitable conventional technique such as spraying, die coating, dip coating, draw bar coating, gravure coating, silk screening, air knife coating, reverse roll coating, vacuum deposition, chemical treatment and the like. The hole blocking layer may be applied in the form of a dilute solution, with the solvent being removed after deposition of the coating by conventional techniques such as by vacuum, heating and the like. Drying of the deposited coating may be achieved by any suitable technique such as oven drying, infrared radiation drying, air drying and the like.

An optional adhesive layer may be applied to the hole blocking layer. Any suitable adhesive layer known in the art may be utilized. Typical adhesive layer materials include, for example, polyesters, polyurethanes, and the like. Satisfactory results may be achieved with adhesive layer thickness of about 0.05 micrometer (500 angstroms) to about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infrared radiation drying, air drying and the like. Suitable adhesives include film-forming polymers, such as polyester, DuPont 49,000 (available from E. I. DuPont de Nemours & Co.), VITEL PE-100 (available from Goodyear Tire and Rubber Co.), polyvinyl butyral, polyvinyl pyrrolidone, polyurethane, polymethyl methacrylate, and the like.

At least one electrophotographic imaging layer is formed on the adhesive layer, hole blocking layer or substrate. The electrophotographic imaging layer may be a single layer that performs both charge generating and charge transport functions as is known in the art or it may comprise multiple layers such as a charge generator layer and charge transport layer. Thus, in fabricating a photoconductive imaging member, a charge generator layer is deposited and a charge transport layer may be deposited either in a laminate type configuration where the charge generator layer and charge transport layer are in different layers or in a single layer configuration where the charge generator layer and charge transport layer are in the same layer along with a binder resin, for example as disclosed in U.S. Pat. Nos. 6,756,169 and 6,946,227, each incorporated herein by reference in its entirety. In embodiments, the charge generator layer is applied prior to the charge transport layer.

Charge generator layers may comprise amorphous films of selenium and alloys of selenium and arsenic, tellurium germanium and the like, hydrogenated amorphous silicon and compounds of silicon and germanium, carbon, oxygen, nitrogen and the like fabricated by vacuum evaporation or deposition. The charge generator layers may also comprise inorganic pigments of crystalline selenium and its alloys; Group II-VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines have been employed as photogenerating materials for use in laser printers using infrared exposure systems. Infrared sensitivity is desired for photoreceptors exposed to low-cost semiconductor laser diode light exposure devices. The absorption spectrum and photosensitivity of the phthalocyanines depend on the central metal atom of the compound. Many metal phthalocyanines have been reported and include, for example, oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms, and have a strong influence on photogeneration.

Any suitable polymeric film-forming binder material may be employed as the matrix in the charge generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, such as from about 20 percent by volume to about 30 percent by volume of the photogenerating pigment dispersed in about 70 percent by volume to about 80 percent by volume of the resinous binder composition. In one embodiment, about 8 percent by volume of the photogenerating pigment is dispersed in about 92 percent by volume of the resinous binder composition. The photogenerator layers can also fabricated by vacuum sublimation, in which case there is no binder.

Any suitable and conventional technique may be utilized to mix and thereafter apply the photogenerating layer coating mixture. Typical application techniques include spraying, dip coating, roll coating, wire wound rod coating, vacuum sublimation and the like. For some applications, the generator layer may be fabricated in a dot or line pattern. Removal of the solvent of a solvent coated layer may be effected by any suitable conventional technique such as oven drying, infrared radiation drying, air drying and the like. In embodiments, the charge generating layer is from about 0.1 micrometers to about 100 micrometers thick, such as from about 0.1 micrometers to about 50 micrometers.

In embodiments, a charge transport layer may be employed. The charge transport layer may comprise a charge transporting polymer, or a charge transporting molecule dissolved or molecularly dispersed in a film forming electrically inert polymer such as a polycarbonate. The term "dissolved" as employed herein refers to, for example, forming a solution in which the small molecule is dissolved in the polymer to form a homogeneous phase. The expression "molecularly dispersed" herein refers to, for example, a charge transporting small molecule dispersed in the polymer, the small molecules being dispersed in the polymer on a molecular scale.

Any suitable charge transporting or electrically active small molecule may be employed in the charge transport layer. A charge transporting small molecule refers to, for example, a monomer that allows the free charge photogenerated in the transport layer to be transported across the transport layer. Typical charge transporting small molecules include, for example, pryazolines such as 1-phenyl-3-(4'-diethylamino styryl)-5-(4"-diethylamino phenyl)pyrazoline, hydrazones such as N-phenyl-N-methyl-3-(9-ethyl)carbazyl hydrazone and 4-diethyl amino benzaldehyde-1,2-diphenyl hydrazone, oxadiazoles such as 2,5-bis (4-N,N'-diethylaminophenyl)-1,2,4-oxadiazole, stilbenes, pyrene, carbazole, oxazole, arylamine, arylmethane, benzidine, thiazole, butadiene compounds, arylamines, such as N,N'-diphenyl-N,N'-bis(alkylphenyl)-1,1-biphenyl-4,4-diamine, N,N'-diphenyl-N,N'-bis(alkylphenyl)-1,1-terphenyl-4,4'-diamine, Tri-p-tolylamine, 1,1-bis(di-4-tolylarninophenyl)cyclohexane, N,N-bis-(3,4-dimethylphenyl)-4-biphenyl amine, N,N',bis-(4-methylphenyl)-N,N'-bis(4-ethylphenyl)-1,1,'-3,3'-dimethylbiphenyl-4,4'-diamine, N,N-bis(2-methyl-2-phenylvinyl)-N,N'-diphenylbenzidine, phenanthrene diamine, 9-9-bis(2-cyanoethyl)-2,7-bis(phenyl-m-tolylamino)fluorene, N,N'-diphenyl-N,N'-bis(3-methylphenyl)-1,1'-biphenyl-4,4'-diamine, and the like. As indicated above, suitable electrically active small molecule charge transporting compounds are dissolved or molecularly dispersed in electrically inactive polymeric film forming materials. A small molecule charge transporting compound that permits injection of holes from the pigment into the charge generating layer with high efficiency and transports them across the charge transport layer with very short transit times is N,N'-diphenyl-N,N'-bis(3-methylphenyl)-1,1'-biphenyl-4,4'-diamine. If desired, the charge transport material in the charge transport layer may comprise a polymeric charge transport material or a combination of a small molecule charge transport material and a polymeric charge transport material.

Any suitable electrically inactive resin binder that is ideally substantially insoluble in the solvent such as alcoholic solvent used to apply the overcoat layer may be employed in the charge transport layer. Typical inactive resin binders include polycarbonate resin, polyester, polyarylate, polyacrylate, polyether, polysulfone, and the like. Molecular weights can vary, such as from about 20,000 to about 150,000. Exemplary binders include polycarbonates such as poly (4,4'-isopropylidene-diphenylene)carbonate (also referred to as bisphenol-A-polycarbonate); polycarbonate, poly (4,4'-cyclohexylidinediphenylene) carbonate (referred to as bisphenol-Z polycarbonate), poly (4,4'-isopropylidene-3,3'-dimethyldiphenyl)carbonate (also referred to as bisphenol-C-polycarbonate), and the like.

Any suitable technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable technique such as oven drying infrared radiation drying, air drying and the like.

Generally, the thickness of the charge transport layer is from about 10 to about 100 micrometers, but a thickness outside this range can also be used. A charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of a charge transport layer to the charge generating layers may be maintained from about 2:1 to 200:1, and in some instances as great as 400:1. Typically, a charge transport layer is substantially non-absorbing to visible light or radiation in the region of intended use but is electrically active in that it allows the injection of photogenerated holes from the photoconductive layer, that is, charge generation layer, and allows these holes to be transported through itself to selectively discharge a surface charge on the surface of the active layer.

Additionally, adhesive layers can be provided, if necessary or desired, between any of the layers in the photoreceptors to ensure adhesion of any adjacent layers. Alternatively, or in addition, adhesive material can be incorporated into one or both of the respective layers to be adhered.

To improve the mechanical properties of a photoreceptor, such as wear, scratch, and or cracking resistance, the imaging member has a protective overcoat layer. The overcoat layer is applied over a single layered photoconductive layer or over the charge transport layer of a multilayered photoconductor. The overcoat layer disclosed herein is derived from a film-forming resin composition comprising at least a hydroxyl group-containing polymer, an alkoxymethylated benzoguanamine compound, and a charge transport compound. In embodiments, the film-forming resin composition may include, for example, from about 5 to about 50 percent by weight, such as from about 10 to about 50 percent by weight or from about 10 to about 40 percent by weight, of hydroxyl group-containing polymer, from about 25 to about 60 percent by weight, such as from about 30 to about 60 percent by weight or from about 30 to about 50 percent by weight, of charge transport compound, and from about 10 to about 70 percent by weight, such as from about 15 to about 70 percent by weight or from about 15 to about 60 percent by weight, of alkoxy group-containing benzoguanamine, although other amounts can be used. The film-forming resin composition disclosed herein is thermally curable to form a crosslinked film.

Any suitable hydroxyl-containing polymers, oligomers, or resins may be used for the present invention. Specific hydroxyl-containing polymers include, for example, an aliphatic polyester, an aromatic polyester, a polyacrylate, an aliphatic polyether, an aromatic polyether, a polycarbonate, a polyurethane, a (polystrene-co-polyacrylate), poly(2-hydroxyethyl methacrylate), an alkyd resin, polyvinylbutylral, and the like, wherein the polymer contains at least a hydroxyl group.

In embodiments, preferred hydroxyl-containing polymers include polymer polyols. A polyol herein refers to, for example, an oligomer or polymer containing multiple pendent hydroxyl groups. Examples of such polyol polymers include an aliphatic polyester polyol, an aromatic polyester polyol, an acrylated polyol, an aliphatic polyether polyol, an aromatic polyether polyol, a (polystyrene-co-polyacrylate) polyol, polyvinyl butylral, poly(2-hydroxyethyl methacrylate) and the like. For example, in embodiments, the polyol polymer can be a polyester polyol or acrylated polyol, such as a highly branched polyester polyol or acrylated polyol. The term "highly branched" refers, for example, to a prepolymer synthesized using a significant amount of trifunctional alcohols, such as triols, to form a polymer having a significant number of branches off of the main polymer chain. This is distinguished from a linear prepolymer that contains only difunctional monomers, and thus little or no branches off of the main polymer chain. The term "polyester polyol" refers, for example, to such compounds that include multiple ester groups as well as multiple alcohol (hydroxyl) groups in the molecule, and which can include other groups such as, for example, ether groups and the like. In embodiments, the polyester polyol can thus include ether groups, or can be free of ether groups. Likewise, the term "acrylated polyol" refers, for example, to such compounds that include multiple ether groups as well as multiple alcohol (hydroxyl) groups in the molecule, and which can include acrylate groups such as, for example, methacrylate groups and the like.

Examples of such suitable polyester polyols include, for example, polyester polyols formed from the reaction of a polycarboxylic acid such as a dicarboxylic acid or a tricarboxylic acid (including acid anhydrides) with a polyol such as a diol or a triol. In embodiments, the number of ester and alcohol groups, and the relative amount and type of polyacid and polyol, should be selected such that the resulting polyester polyol compound retains a number of free hydroxyl groups, which can be used for subsequent crosslinking of the material in forming the overcoating layer binder material. For example, suitable polycarboxylic acids include, but are not limited to, adipic acid ($COOH[CH_2]_4COOH$), pimelic acid ($COOH[CH_2]_5COOH$), suberic acid ($COOH[CH_2]_6COOH$), azelaic acid ($COOH[CH_2]_7COOH$), sebasic acid ($COOH[CH_2]_8COOH$), and the like. Suitable polyols include, for example, difunctional materials such as glycols or trifunctional alcohols such as triols and the like, including propanediols ($HO[CH_2]_3OH$), butanediols ($HO[CH_2]_4OH$), hexanediols ($HO[CH_2]_6OH$), glycerine ($HOCH_2CHOHCH_2OH$), 1,2,6-hexanetriol ($HOCH_2CHOH[CH_2]_4OH$), and the like.

In embodiments, the suitable polyester polyols are reaction products of polycarboxylic acids and polyols and can be represented by the following formula (1):

$$[—CH_2—R_a—CH_2]_m—[—CO_2—R_b—CO_2—]_n—[—CH_2—R_c—CH_2]_p—[—CO_2—R_d—CO_2—]_q \quad (1)$$

where Ra and Rc independently represent linear alkyl groups or branched alkyl groups derived from the polyols, the alkyl groups having from 1 to about 20 carbon atoms; Rb and Rd independently represent alkyl or aryl groups derived from the polycarboxylic acids the alkyl groups having from 1 to about 20 carbon atoms; the aryl groups having from 6 to about 60 carbon atoms and m, n, p, and q independently represent mole fractions of from 0 to 1, such that n+m+p+q=1.

Specific commercially available examples of such suitable polyester polyols include, for example, the DESMOPHEN® series of products available from Bayer Chemical, including DESMOPHEN® 800, 1110, 1112, 1145, 1150, 1240, 1262, 1381, 1400, 1470, 1630, 2060, 2061, 2062, 3060, 4027, 4028, 404, 4059, 5027, 5028, 5029, 5031, 5035, and 5036; the SOVERMOL® series of products available from Cognis, including SOVERMOL® 750, 805, 815, 908, 910, and 913; and the HYDAGEN® series of products available from Cognis, including HYDAGEN® HSP; and mixtures thereof. In embodiments, DESMOPHEN® 800 and SOVERMOL® 750, or mixtures thereof, may be used. DESMOPHEN® 800 is a highly branched polyester bearing hydroxyl groups, having an acid value of ≦4 mg KOH/g, a hydroxyl content of about 8.6±0.3%, and an equivalent weight of about 200. DESMOPHEN® 800 corresponds to the above formula (1) where the polymer contains 50 parts adipic acid, 10 parts phthalic anhydride, and 40 parts 1,2,6-hexanetriol, where Rb=—$[CH_2]_4$—, n=0.5, Rd=–1,2-$C_6H_4$—, q=0.1, Ra=Rc=—$CH_2[CHO—][CH_2]_4$—, and m+p=0.4. DESMOPHEN® 1100 corresponds to the above formula (1) where the polymer contains 60 parts adipic acid, 40 parts 1,2,6-hexanetriol, and 60 parts 1,4-butanediol, where Rb=Rd=—$[CH_2]_4$—, n+q=0.375, Ra=—$CH_2[CHO—][CH_2]_4$—, m=0.25, Rc=—$[CH_2]_4$—, and p=0.375. SOVERMOL® 750 is a branched polyether/polyester/polyol having an acid value of ≦2 mg KOH/g, and a hydroxyl value of 300-330 mg KOH/g.

In other embodiments, the polyol can be an acrylated polyol. Suitable acrylated polyols can be, for example, the reaction products of propylene oxide modified with ethylene oxide, glycols, triglycerol and the like. These polyols are further reacted with substituted acrylic acids, alcohol containing acrylates, substituted acryloyl chlorides, and the like, forming terminal acrylate groups. Such acrylated polyols can be represented by the following formula (2):

$$[R_t—CH_2]_t—[—CH_2—R_a—CH_2]_p—[—CH_2O—R_b—CH_2O—]_n—[—CH_2—R_c—CH_2]_p—[—CH_2O—R_d—CH_2O—]_q \quad (2)$$

where $R_t$ represents $CH_2CR_1CO2$- where $R_1$ is an alkyl group of from 1 to about 20 carbon atoms or more such as methyl, ethyl, and the like and where t represents mole fractions of acrylated sites from 0 to 1. Ra and Rc independently represent linear alkyl/alkoxy groups or branched alkyl/alkoxy groups derived from the polyols, the alkyl/alkoxy groups having from 1 to about 20 carbon atoms; Rb and Rd independently represent alkyl/alkoxy groups, the alkyl/alkoxy groups having from 1 to about 20 carbon atoms; and m, n, p, and q independently represent mole fractions of from 0 to 1, such that n+m+p+q=1. In formula (2), the notation "$[R_t—CH2-]_t$-" indicates that the acrylate groups react with some of the hydroxyl groups in the main chain or branches of the polyol component.

In other embodiments, the polyol can be a polyether polyol. Suitable polyether polyols can be, for example, the reaction products of propylene oxide modified with ethylene oxide, glycols, triglycerol and the like. Such polyols can be represented by the following formula (3):

$$—[—CH_2—R_a—CH_2]_m—[—CH_2O—R_b—CH_2O—]_n—[—CH_2—R_c—CH_2]_p—[—CH_2O—R_d—CH_2O—]_q \quad (3)$$

where Ra and Rc independently represent linear alkyl/alkoxy groups or branched alkyl/alkoxy groups derived from the polyols, the alkyl/alkoxy groups having from 1 to about 20 carbon atoms; Rb and Rd independently represent alkyl/alkoxy groups, the alkyl/alkoxy groups having from 1 to about 20 carbon atoms; aryl groups having from 6 to about 60 carbon atoms and m, n, p, and q represent mole fractions of from 0 to 1, such that n+m+p+q=1. Typical examples of aromatic polyether polyols include bisphenol A ethoxylate, bisphenol A propoxylate, bisphenol A propoxylate/ethoxylate, poly(bisphenol A-co-epichlorohydrin), and the like.

In other embodiments, the compositions for forming the overcoating layer may contain any suitable film-forming phenolic resins, such as a resole-type phenolic resin or a novolac-type phenolic resin. A resole-type phenolic resin may be formed through a reaction between a phenol and aldehyde, in the presence of a base catalyst. A novolac-type resin may be formed through a reaction between a phenol and an aldehyde, in the presence of an acid catalyst. Of course, suitable phenolic resins may also be commercially obtained.

For resole-type phenolic resin (or resole phenolic resin), a weight average molecular weight of the resin may range from, for example, about 300 to about 50,000, such as from about 500 to about 35,000 or from about 1,000 to about 35,000, for example as determined by known methods such as gel permeation chromatography. Resole phenolic resins that may be employed herein include, for example, PL4852 (Gun'ei Kagaku Kogyo K. K.), formaldehyde polymers with phenol, p-tert-butylphenol and cresol, such as VARCUM® 29159 and 29101 (OxyChem Company) and DURITE® 97 (Borden Chemical), formaldehyde polymers with ammonia, cresol and phenol, such as VARCUM® 29112 (OxyChem Company), formaldehyde polymers with 4,4'-(1-methylethylidene)bisphenol, such as VARCUM® 29108 and 29116 (OxyChem Company), formaldehyde polymers with cresol and phenol, such as VARCUM® 29457 (OxyChem Company), DURITE® SD-423A, SD-422A (Borden Chemical), or formaldehyde polymers with phenol and p-tert-butylphenol, such as DURITE® ESD 556C (Borden Chemical).

For novolac-type phenolic resin (or novolac phenolic resin), a weight average molecular weight of the resin may range from, for example, about 300 to about 50,000, such as from about 500 to about 35,000 or from about 1,000 to about 35,000, for example as determined by known methods such as gel permeation chromatography. Examples of novolac phenolic resins include 471×75 (cured with HY283 amide hardener), ARALDITE PT810, ARALDITE MY720, and ARALDITE EPN 1138/1138 A-84 (multifunctional epoxy and epoxy novolac resins) from Ciba-Geigy; ECN 1235, 1273 and 1299 (epoxy cresol novolac resins) from Ciba- Geigy; TORLON AI-10 (poly(amideimide) resin) from Amoco; THIXON 300/301 from Whittaker Corp.; TACTIX (tris(hydroxyphenyl) methane-based epoxy resins, oxazolidenone modified tris(hydroxyphenyl) methane-based epoxy resins, and multifunctional epoxy-based novolac resins) from Dow Chemical; and EYMYD resin L-20N (polyimide resin) from Ethyl Corporation, and the like.

In forming the overcoating layer, a benzoguanamine compound or resin is used as a curing or crosslinking agent. The benzoguanamine compound or resin provides reactive sites that interact with the hydroxyl groups of the hydroxyl group-containing polymer, to provide a cured or crosslinked structure. Where the charge transport compound also includes a hydroxyl or alkoxy group, it can also participate in the crosslinking so as to also become a part of the crosslinked structure of the overcoat layer.

In embodiments, the benzoguanamine compound contains at least one —$CH_2OR$ group, wherein each such R is independently an H atom or an alkyl group having from 1 to about 20 carbon atoms, for example such as from 1 to about 15 or from 1 to about 10 carbon atoms.

In specific embodiments, the benzoguanamine compound comprises a formula structure represented by:

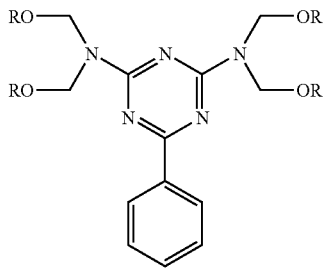

wherein R is a hydrogen, an alkyl group having from 1 to about 10 C atoms, or a mixture thereof. The alkyl group may be selected from the group consisting of a methyl, an ethyl, a propyl, a butyl, and a mixture thereof.

In still other embodiments, the benzoguanamine compound is comprised of a benzoguanamine-formaldehyde resin. A benzoguanamine-formaldehyde resin may be formed through a condensation reaction between a benzoguamine and aldehyde. Suitably, the benzoguanamine-formaldehyde resin contains at least one —$CH_2OR$ group, wherein each such R is independently an H atom or an alkyl group having from 1 to about 20 carbon atoms, for example wherein the —$CH_2OR$ group is an alkoxylmethyl group having from 1 to about 10 carbon atoms, such as an alkoxymethyl selected from the group consisting of a methoxymethyl, an ethoxymethyl, a propoxymethyl, a butoxymethyl, and a mixture thereof. Commercially available benzoguanamine-formaldehyde resins, such as CYMEL 1123 and 5010 from Cytec Industries Inc, may be used as the curing agent.

Any suitable charge transport material may be utilized in the overcoating layer. However, to provide one or more desired benefits including resistance to cracking, desired mechanical properties, resistance to image deletion, and the like, embodiments include a hydroxyl-containing hole transport compound as a charge transporting molecule.

Exemplary hydroxyl-containing charge transport compounds include those of the following formula:

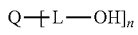

wherein Q represents a charge transport component, L represents a divalent linkage group, and n represents a number of repeating segments or groups, for example from 1 to about 8, such as from 1 to about 6 or from 1 to about 4.

Any suitable charge transport compound can be used as the moiety Q. For example, suitable charge transport compounds include amines, such as tertiary arylamines, pyrazolines, hydrazones, oxaliazoles, stilbenes, and mixtures thereof.

More specifically, in embodiments, Q is represented by the following general formula

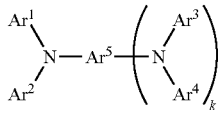

wherein $Ar^1$, $Ar^2$, $Ar^3$, $Ar^4$ and $Ar^5$ each independently represents a substituted or unsubstituted aryl group, or $Ar^5$ independently represents a substituted or unsubstituted arylene group, and k represents 0 or 1, wherein at least one of $Ar^1$, $Ar^2$, $Ar^3$ and $Ar^4$ is connected to the linkage group L.

For example, in embodiments, $Ar^1$, $Ar^2$, $Ar^3$, $Ar^4$ and $Ar^5$ each independently represents a substituted or unsubstituted aryl group, such as

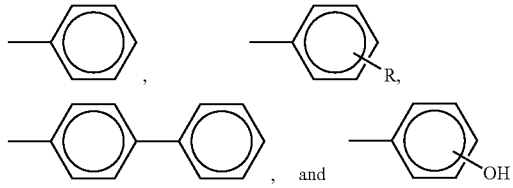

where R is selected from the group consisting of an alkyl group having 1 to about 10 carbon atoms, such as —$CH_3$, —$C_2H_5$, —$C_3H_7$, and —$C_4H_9$, or $Ar^5$ independently represents a substituted or unsubstituted arylene group, such as

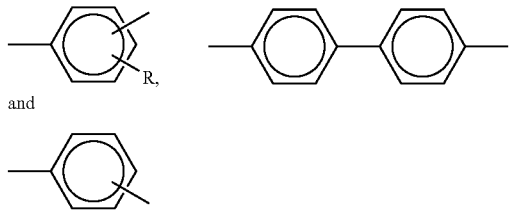

where R is selected from the group consisting of an alkyl group having 1 to about 10 carbon atoms, such as —$CH_3$, —$C_2H_5$, —$C_3H_7$, and —$C_4H_9$. Other suitable groups for $Ar^5$, when k is greater than 0, include:

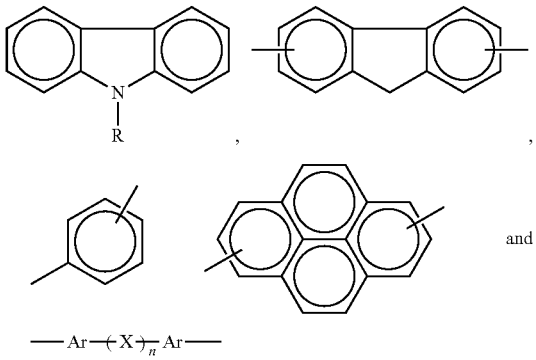
where n if 0 or 1, Ar is any of the group defined above for $Ar^1$, $Ar^2$, $Ar^3$, $Ar^4$ and $Ar^5$, and X is selected from the group consisting of:
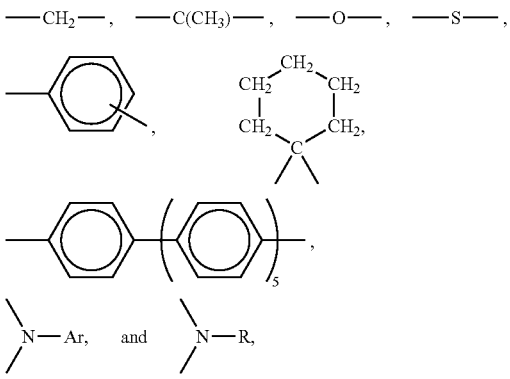
where s is 0, 1 or 2.
In embodiments, more specifically, Q is a compound selected from the following:
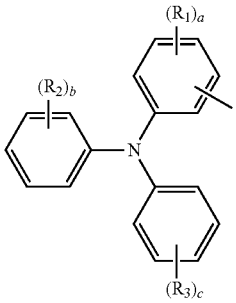
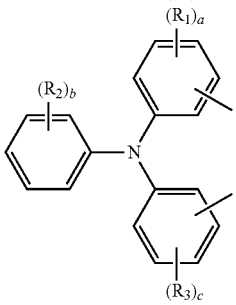
-continued
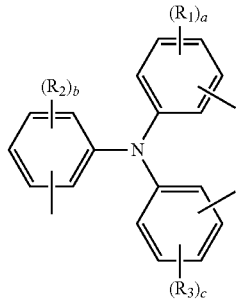
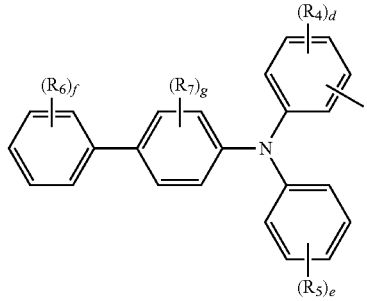
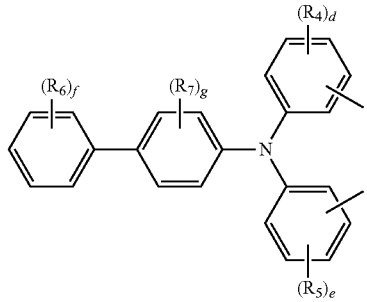
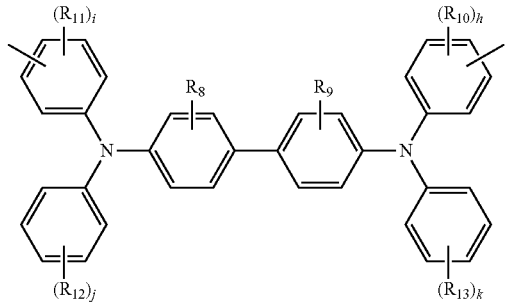
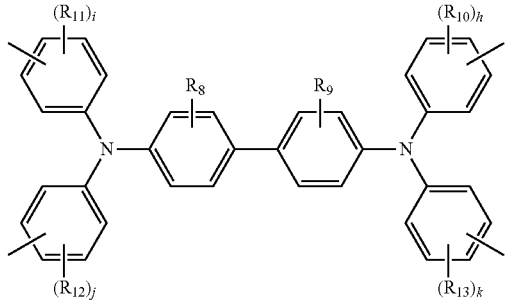

-continued

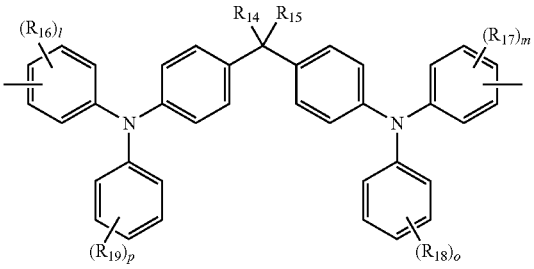

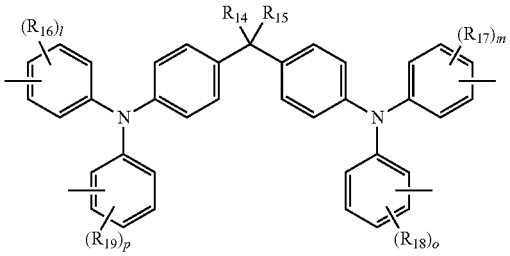

and mixtures thereof, wherein $R_1$ to $R_{19}$ are independently selected from the group comprised of a hydrogen atom, an alkyl such as having from 1 to about 20 carbon atoms, a cyclic alkyl such as having from 4 to about 20 carbon atoms, an alkoxyl group such as having from 1 to about 20 carbon atoms, and halogen, and subscripts a to p each independently represents an integer of 1 or 2.

In the above exemplary hydroxyl-containing charge transport compound, L represents a divalent linkage group. In embodiments, the divalent linkage L can be a divalent hydrocarbyl group such as containing from 1 to about 20 carbon atoms or from 1 to about 15 carbon atoms, optionally further containing a heteroatom such as oxygen, sulfur, silicon and/or nitrogen. Specific examples of suitable divalent linkage groups L include alkyl groups —(—$CH_2$)$_y$—, where y is an integer from 1 to about 15 or from 1 to about 10, such as methylene or ethylene, and its combination with a group selected from the following:

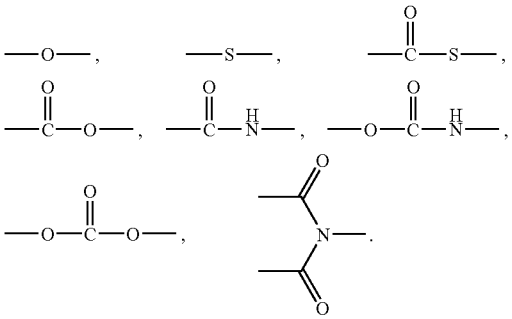

In the above exemplary hydroxyl-containing charge transport compounds, n represents an integer of 1 to about 8. In embodiments, n is 1 to about 3 or 1 to about 4, such as 1, 2, 3, or 4. For example, when n=2, the compound is represented as a dihydroxyalkyl arylamine compound charge transporting molecule.

Illustrative examples of the hydroxyl-containing charge transport compounds include:

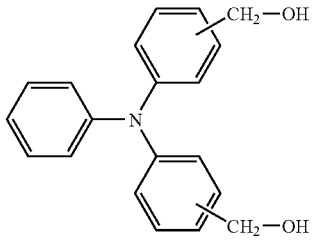

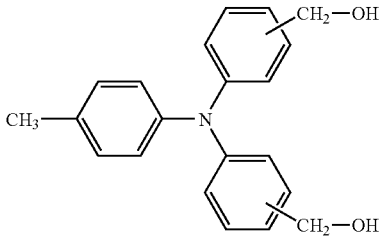

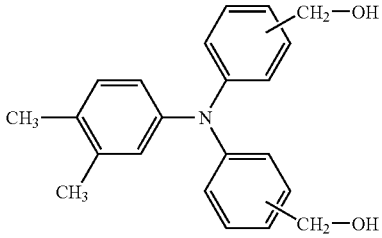

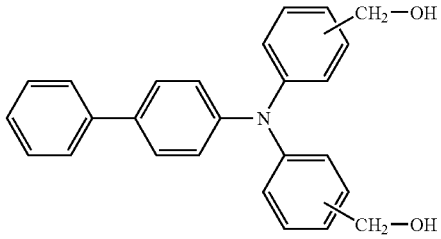

and mixtures thereof.

In embodiments, the hydroxyl-containing charge transport compounds can be selected from the following:

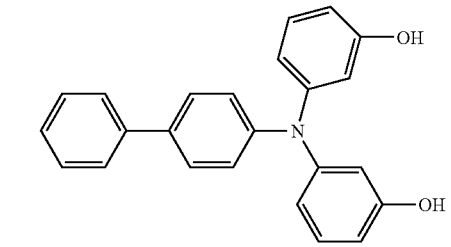

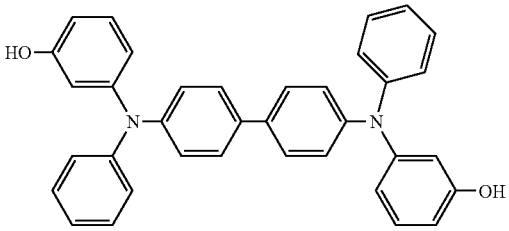

and

-continued

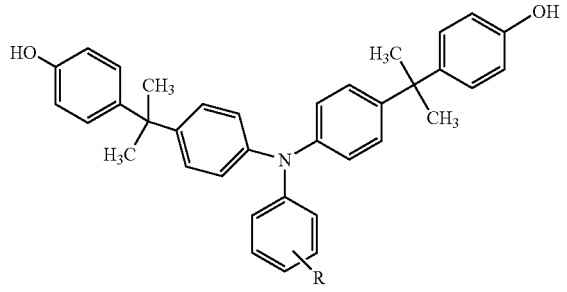

wherein R is selected from the group consisting of a hydrogen atom, an alkyl, a cyclic alkyl, an alkoxyl group, and an aryl.

If desired, the hydroxyl-containing charge transport compound, such as a hydroxyalkyl arylamine, can be used in combinations of two or more, such as two, three, four or more different hydroxyl-containing charge transport compounds, or one or more hydroxyl-containing charge transport compounds can be used in combination with one or more other types of charge transporting molecules.

As mentioned above, by virtue of the charge transport compound containing at least one hydroxyl-group, the charge transport compound is also able to participate in the crosslinking of the overcoating layer, and thus may become a part of the resulting crosslinked structure.

The film-forming resin composition disclosed herein is thermally curable to form a crosslinked film. Crosslinking may be accomplished by heating in the presence of a catalyst. Thus, the solution of the overcoat film forming composition can also include a suitable catalyst. Any suitable catalyst may be employed. Typical catalysts include, for example, oxalic acid, maleic acid, carbollylic acid, ascorbic acid, malonic acid, succinic acid, tartaric acid, citric acid, toluenesulfonic acid, methanesulfonic acid, benzenesulfonic acid, naphthalenesulfonic acid, hydrochloric acid, sulfuric acid, nitric acid, acetic acid, trifluoroacetic acid, formic acid, glycolic acid, glyoxylic acid, poly(acrylic acid), poly(vinyl chloride-co-vinyl acetate-co-maleic acid), mixtures thereof, derivatives thereof and the like. Organic acid catalysts such as acetic acid, trifluoroacetic acid, oxalic acid, formic acid, glycolic acid, glyoxylic acid, toluenesulfonic acid, mixtures thereof and derivatives thereof, and the like, may be desirably used. Derivates of the catalyst refers to, for example, salts thereof, for example salts with an organic base, such as pyridine, piperidine, and the like. Commercially available catalyst, such as CYCAT 4040 from Cytec Industries Inc. and NACURE 5225 from King Industries may be selected.

The catalyst may be present in the overcoat coating composition in an amount from about 0.01 weight percent to about 10 weight percent, such as from about 0.1 weight percent to about 5 weight percent or from about 0.5 weight percent to about 3 weight percent, of the overcoat coating composition.

As desired, the overcoating layer can also include other materials, such as abrasion resistant fillers, and the like, in any suitable and known amounts.

Typical application techniques for applying the film-forming composition onto the photoreceptor include spraying, dip coating, roll coating, wire wound rod coating, and the like. For many coating techniques, the film-forming composition may be diluted with an organic solvent. Any suitable alcohol solvent may be employed for the overcoat composition. Typical alcohol solvents include, for example, butanol, propanol, methanol, 1-methoxy-2-propanol, and the like and mixtures thereof. Other suitable solvents that can be used in forming the overcoating layer solution include, for example, tetrahydrofuran, monochlorobenzene, and mixtures thereof. These solvents can be used in addition to, or in place of, the above alcohol solvents, or they can be omitted entirely. However, in some embodiments, higher boiling alcohol solvents are avoided, as they may interfere with the desired crosslinking reaction.

The film-forming composition, after applying onto the photoreceptor, is typically subject to a thermal curing process to form a crosslinked overcoat layer. The thickness of the overcoat layer after curing may arrange from about 0.5 micron to about 10 microns, preferably from about 1 microns to about 5 microns. The temperature used for crosslinking varies with the specific catalyst and heating time utilized and the degree of crosslinking desired. Generally, the degree of crosslinking selected depends upon the desired flexibility of the final photoreceptor. For example, complete crosslinking may be used for rigid drum or plate photoreceptors. However, partial crosslinking can be beneficial for flexible photoreceptors having, for example, web or belt configurations. The degree of crosslinking can be controlled by the relative amount of catalyst employed. The amount of catalyst to achieve a desired degree of crosslinking will vary depending upon the specific coating solution materials, such as hydroxyl group-containing compound, catalyst, temperature and time used for the reaction. In embodiments, the curing temperature may range from about 50° C. to about 200° C., preferably from about 80° C. to about 150° C. During the curing process, the solvent used for preparing the coating solution is removed by vapor evaporation. After crosslinking, the overcoating should be substantially insoluble in the solvent in which it was soluble prior to crosslinking. Thus, no overcoating material will be removed when rubbed with a cloth soaked in the solvent. Crosslinking results in the development of a three dimensional network which restrains the transport molecule in the crosslinked polymer network.

Advantages provided by the overcoating layers include providing a photoreceptor with excellent electrical characteristics and print quality. Further, as a result of the use of the alkoxy group-containing benzoguanamine, which exhibits hydrophobic properties, the overcoat layer exhibits improved water and humidity resistance, thereby achieving a photoreceptor that exhibits improved avoidance of print deletion in high humidity environments. The alkoxy group-containing benzoguanamine is also expected to impart a higher gloss to the photoreceptor, resulting in a more robust film with increased scratch resistance.

Also, included within the scope of the present disclosure are methods of imaging and printing with the imaging members illustrated herein. These methods generally involve the formation of an electrostatic latent image on the imaging member; followed by developing the image with a toner composition comprised, for example, of thermoplastic resin, colorant, such as pigment, charge additive, and surface additives, reference U.S. Pat. Nos. 4,560,635, 4,298,697 and 4,338,390, the disclosures of which are totally incorporated herein by reference; subsequently transferring the image to a suitable substrate; and permanently affixing the image thereto. In those environments wherein the device is to be used in a printing mode, the imaging method involves the same steps with the exception that the exposure step can be accomplished with a laser device or image bar. The imaging method may be carried out using an imaging device that includes, for example, at least one charging unit, at least one exposing unit, at least one developing unit where an image is developed using the toner, and a transfer unit, wherein the imaging is carried out using the electrophotographic imaging member described herein. The device may further include other conventional components, for example such as a cleaning unit for the imaging member.

An example is set forth hereinbelow and is illustrative of different compositions and conditions that can be utilized in practicing the disclosure. All proportions are by weight unless otherwise indicated. It will be apparent, however, that the disclosure can be practiced with many types of compositions and can have many different uses in accordance with the disclosure above and as pointed out hereinafter.

Example 1

Preparation of Tetrabutoxymethylbenzoguanamine (TBMBG)

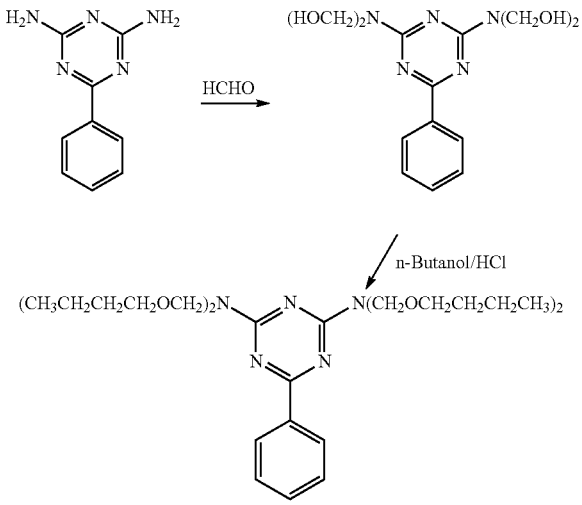

To a flask are added 46.75 grams of benzoguanamine and 129.75 ml of 37% formaldehyde solution at pH 7.9. The mixture is heated at 71° C. for 1 hour and then allowed to cool slowly to ambient temperature (23~25° C.). The white solid is filtered, washed with methanol, and dried in vacuum oven at 50° C. to yield 30.5 grams of tetrahydroxymetlhylbenzoguanamine.

To a flask are added 27.65 grams of tetrahydroxymethylbenzoguanamine obtained above, 75 ml of butanol, and 2 ml of concentrated hydrochloric acid. The mixture is stirred at ambient temperature for 1 hour. The excess amount of the butanol is removed by evaporation under reduced pressure to yield 47.3 grams of tetrabutoxymethylbenzoguanamine.

Examples 2-7

Imaging Members Having an Overcoat Layer

An electrophotographic imaging member web stock is prepared by providing a 0.02 micrometer thick titanium layer coated on a biaxially oriented polyethylene naphthalate substrate (KADALEX, available from ICI Americas, Inc.) having a thickness of 3.5 mils (89 micrometers) and applying thereto, using a gravure coating technique and a solution containing 10 parts of gamma aminopropyltriethoxy silane, 10.1 parts of distilled water, 3 parts of acetic acid, 684.8 parts of 200 proof denatured alcohol and 200 parts of heptane. This layer is then allowed to dry for 5 minutes at 135° C. in a forced air oven. The resulting blocking layer has an average dry thickness of 0.05 micrometer measured with an ellipsometer.

An adhesive interface layer is then prepared by applying with extrusion process to the blocking layer a wet coating containing 5 percent by weight based on the total weight of the solution of polyester adhesive (MOR-ESTER 49,000, available from Morton International, Inc.) in a 70:30 volume ratio mixture of tetrahydrofuran:cyclohexanone. The adhesive interface layer is allowed to dry for 5 minutes at 135° C. in a forced air oven. The resulting adhesive interface layer has a dry thickness of 0.065 micrometer.

The adhesive interface layer is thereafter coated with a photogenerating layer. The photogenerating layer dispersion is prepared by introducing 0.45 part of Iupilon 200 (PC-Z 200) available from Mitsubishi Gas Chemical Corp and 50 parts of tetrahydrofuran into a glass bottle. To this solution is added 2.4 parts of hydroxygallium phthalocyanine and 300 parts of ⅛ inch (3.2 millimeter) diameter stainless steel shot. This mixture is then placed on a ball mill for 20 to 24 hours. Subsequently, 2.25 parts of PC-Z 200 is dissolved in 46.1 parts of tetrahydrofuran, then added to this OHGaPc slurry. This slurry is then placed on a shaker for 10 minutes. The resulting slurry is, thereafter, coated onto the adhesive interface by an extrusion application process to form a layer having a wet thickness of 0.25 mil. However, a strip about 10 mm wide along one edge of the substrate web bearing the blocking layer and the adhesive layer is deliberately left uncoated by any of the photogenerating layer material to facilitate adequate electrical contact by the ground strip layer that is applied later. This photogenerating layer is dried at 135° C. for 5 minutes in a forced air oven to form a dry thickness photogenerating layer having a thickness of 0.4 micrometer layer.

Onto the photogenerating layer of the imaging member web is simultaneously coated with a charge transport layer and a ground strip layer using extrusion co-coating process. The charge transport layer is prepared by introducing into an amber glass bottle a weight ratio of 1:1 N,N'-diphenyl-N,N'-bis(3-methylphenyl)-1,1'-biphenyl-4~4'-diamine, and MAKROLON 5705, a polycarbonate resin having a weight average molecular weight of about 120,000 commercially available from Bayer A. G. The resulting mixture is dissolved to give a 15 percent by weight solid in 85 percent by weight methylene chloride. This solution is applied onto the photogenerator layer to form a coating which upon drying has a thickness of 29 micrometers.

The approximately 10 mm wide strip of the adhesive layer left uncoated by the photogenerator layer is coated over with a ground strip layer during the co-coating process. This ground strip layer, after drying along with the co-coated charge transport layer at 135° C. in the forced air oven for minutes, has a dried thickness of about 19 micrometers. This ground strip is electrically grounded, by conventional means such as a carbon brush contact means during conventional xerographic imaging process.

An anticurl coating is prepared by combining 8.82 parts of polycarbonate resin (MAKROLON 5705, available from Bayer A G), 0.72 part of polyester resin (VITEL PE-200, available from Goodyear Tire and Rubber Company) and 90.1 parts of methylene chloride in a glass container to form a coating solution containing 8.9 percent solids. The container is covered tightly and placed on a roll mill for about 24 hours until the polycarbonate and polyester are dissolved in the methylene chloride to form the anticurl coating solution. The anticurl coating solution is then applied to the rear surface (side opposite the photogenerator layer and charge transport layer) of the imaging member web stock, again by extrusion coating process, and dried at 135° C. for about 5 minutes in the forced air oven to produce a dried film thickness of about 17 micrometers. The resulted photoconductor sheet is used for applying an overcoat layer of the present invention.

An overcoat coating solution is prepared as follow: One part of a hydroxyl-containing polymer, 0.6 part of a benzoguanamine curing agent, 0.8 part of a charge transport compound, and 0.016 part of an acid catalyst are dissolved in 7.2 parts of 1-methoxy-2-propanol as a solvent at room temperature (about 20° C. to about 25° C.). The mixture is filtered through a 0.45 micron filter to form a coating solution. The coating composition is then applied using a 0.125 mil Bird bar applicator onto the charge transport layer of the photoconductor sheet, and cured at 125° C. for 5 minutes. The result is an imaging member having an overcoating layer thickness of about 3 microns.

Comparative Example

Imaging Member without an Overcoat Layer

An imaging member was fabricated in the same manner as described above except that the overcoating layer is omitted. This imaging member is used as a control.

TABLE 1

Imaging Members and Testing Results

| | Formulation | | | | Testing Results | | |
|---|---|---|---|---|---|---|---|
| Example | Polyol Polymer | CTM | Curing Agent | Catalyst | PIDC | Imaging Quality | Cracking |
| Control | | no overcoat layer | | | Good | some deletion | Severe |
| Example 2 | Desmophen 800 | CTM-1 | TBMBG | pTSA | Comparable to control | No deletion | Better then control |
| Example 3 | Polychem 7558 | CTM-1 | TBMBG | pTSA | Comparable to control | No deletion | Better than control |
| Example 4 | Desmophen 800 | CTM-1 | Cymel 1123 | pTSA | Comparable to control | No deletion | Better then control |
| Example 5 | Desmophen 800 | CTM-1 | Cymel 1123 | pTSA pyridinium | Comparable to control | No deletion | Better than control |
| Example 6 | Polychem 7558 | CTM-1 | Cymel 1123 | pTSA | Comparable to control | No deletion | Better than control |
| Example 7 | Desmophen 800 | CTM-2 | Cymel 1123 | pTSA | Comparable to control | some deletion | Better than control |

Note:
DESMOPHEN 800: A polyester resin available from Bayer MaterialScience
POLYCHEM 7558: Polyacrylic polyol resin available from OPC Polymers
TBMBG: Tetrabutoxymethylbenzoguanamine from Example 1
CYMEL 1123: An alkylated benzoguanamine-formaldehyde resin available from Cytec Industries
p-TSA: p-Toluenesulfonic acid (Aldrich)
Charge Transport Molecule (CTM):

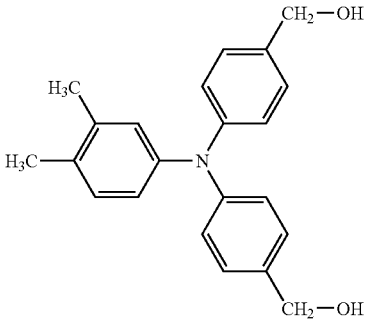

CTM-1

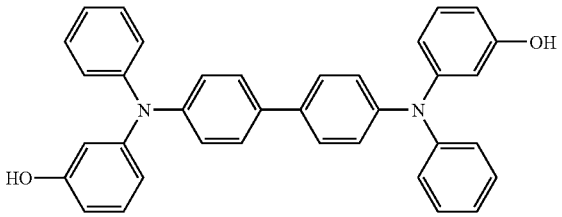

CTM-2

Testing of Imaging Members

The imaging members of Examples 2-7 and Comparative Example are tested for their electrostatographic sensitivity and cycling stability in a scanner. The scanner is known in the industry and equipped with means to rotate the drum while it is electrically charged and discharged. The charge on the sample is monitored through use of electrostatic probes placed at precise positions around the circumference of the device. The samples in this Example are charged to a negative potential of 500 Volts. As the device rotates, the initial charging potential is measured by voltage probe 1. The sample is then exposed to monochromatic radiation of known intensity, and the surface potential measured by voltage probes 2 and 3. Finally, the sample is exposed to an erase lamp of appropriate intensity and wavelength and any residual potential is measure by voltage probe 4. The process is repeated under the control of the scanner's computer, and the data is stored in the computer. The PIDC (photo induced discharge curve) is obtained by plotting the potentials at voltage probes 2 and 3 as a function of the light energy. The testing results are summarized in Table 1. All photoreceptors with an overcoat layer show comparable PIDC characteristics as the control device.

Image deletion tests are also conducted on the imaging members of Examples 2-7 and Comparative Example. The test is conducted by laminating a strip (about 8 inch×1.5 inch) of the overcoated imaging member of Examples 2-7 and a strip (about 8 inch×1.5 inch) of the reference imaging member of Comparative Example on the photoreceptor drum of a Xerox DOCUCENTRE 12 office machine using conductive adhesive tape. The tape is used to hold the laminated strips in place and also to provide electrical contact between the conductive layer in each of the two strips and the drum metal base. The drum configuration is then mounted in an axial scanner equipped with a scorotron charging element and an erase laser bar. The scanner allows for the repetitive charging and discharging of the drum configuration by means of rotating the drum at a rate of 150 cycles per minute between the scorotron (where the drum surface in close proximity to the scorotron gets charged to a potential of about 750 volts) and discharged by means of exposure to the laser beam. The cycling is carried in ambient conditions for a total of about 170,000 cycles. Following cycling, the drum configurations are then removed from the axial scanner and mounted in a Xerox DOCUCENTRE 12 office machine. The machine is then used to print a variable-width multiple-lined print pattern on 11"×17" standard white paper. The printed pattern is then examined visually on the paper for line blurriness. A comparison between print patterns produced by drum areas laminated by a strip of the overcoated imaging member of Examples 2-7 and a strip of the reference imagine member of Comparative Example is then done. The testing showed that the imaging member of Examples 2-6 were very resistant to image deletion, exhibiting stable performce over 170,000 cycles. The imaging members of Comparative Example and Example 7 showed exhibited image deletion after about 50,000 cycles.

The craking resistance test of the imaging members was conducted using a in-house testing fixture. The degree of cracking was estimated under optical microscopoic technique. The results indicate that the imaging members having an overcoat layer possess much improved cracking resistance with respect to the control.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An electrophotographic imaging member having an overcoat layer, the overcoat layer comprising a cured film formed from a composition comprising at least a hydroxyl group-containing polymer selected from the group consisting of a polyester polyol represented by formula (1):

$$[—CH_2—R_a—CH_2]_m—[—CO_2—R_b—CO_2—]_n—[—CH_2—R_c—CH_2]_p—[—CO_2—R_d—CO_2—]_q \quad (1)$$

wherein Ra and Rc independently represent linear or branched alkyl groups having from 1 to about 20 carbon atoms and being derived from a polyol; Rb and Rd independently represent alkyl groups having from 1 to about 20 carbon atoms or aryl groups having from 6 to about 60 carbon atoms and being derived from a polycarboxylic acid, m, n, p, and q independently represent mole fractions of from 0 to 1 and n+m+p+q=1, an acrylated polyol represented by formula (2):

$$[R_t—CH_2]_t—[—CH_2—R_a—CH_2]_p—[—CH_2O—R_b—CH_2O—]_n—[—CH_2—R_c—CH_2]_p—[—CH_2O—R_d—CH_2O—]_q \quad (2)$$

wherein $R_t$ represents $CH_2CR_1CO_2$— where $R_1$ is an alkyl group of from 1 to about 20 carbon atoms or more and where t represents mole fractions of acrylated sites from 0 to 1; Ra and Rc independently represent linear alkyl or alkoxy groups or branched alkyl or alkoxy groups derived from a polyol, the alkyl or alkoxy groups having from 1 to about 20 carbon atoms; Rb and Rd independently represent alkyl or alkoxy groups, the alkyl or alkoxy groups having from 1 to about 20 carbon atoms; and m, n, p, and q independently represent mole fractions of from 0 to 1 and n+m+p+q=1, a polyether polyol represented by formula (3):

$$—[—CH_2—R_a—CH_2]_m—[—CH_2O—R_b—CH_2O—]_n—[—CH_2—R_c—CH_2]_p—[—CH_2O—R_d—CH_2O—]_q \quad (3)$$

wherein Ra and Rc independently represent linear alkyl or alkoxy groups or branched alkyl or alkoxy groups derived from a polyol, the alkyl or alkoxy groups having from 1 to about 20 carbon atoms; Rb and Rd independently represent alkyl or alkoxy groups, the alkyl or alkoxy groups having from 1 to about 20 carbon atoms, or aryl groups having from 6 to about 60 carbon atoms; and m, n, p, and q represent mole fractions of from 0 to 1 and n+m+p+q=1, and mixtures thereof, a benzoguanamine compound represented by:

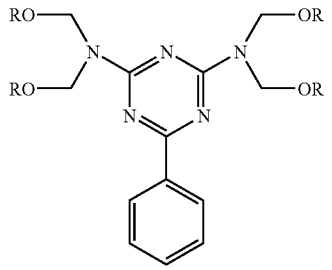

wherein R is an alkyl group having from 1 to about 10 carbon atoms, or a mixture thereof, and a charge transport compound represented by:

$$Q—[L—OH]_n$$

wherein Q represents a charge transport component, L represents a divalent linkage group, and n represents a number of from 1 to about 8.

2. The electrophotographic imaging member according to claim 1, wherein the alkyl group of the benzoguanamine compound is selected from the group consisting of a methyl, an ethyl, a propyl, a butyl, and a mixture thereof.

3. The electrophotographic imaging member according to claim 1, wherein the benzoguanamine compound is a resin.

4. The electrophotographic imaging member of claim 1, wherein the linkage group L is selected from the group consisting of divalent hydrocarbyl groups containing from 1 to about 15 carbon atoms, optionally further containing a heteroatom selected from the group consisting of oxygen, sulfur, silicon, and nitrogen.

5. The electrophotographic imaging member of claim 1, wherein the linkage group L is a methylene.

6. The electrophotographic imaging member of claim 1, wherein Q is represented by the following general formula

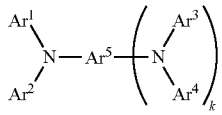

wherein $Ar^1$, $Ar^2$, $Ar^3$, $Ar^4$ and $Ar^5$ each independently represents a substituted or unsubstituted aryl group, or $Ar^5$ independently represents a substituted or unsubstituted arylene group, and k represents 0 or 1, wherein at least one of $Ar^1$, $Ar^2$, $Ar^3$ and $Ar^4$ is connected to the linkage group L.

7. The electrophotographic imaging member of claim 1, wherein the charge transport compound is selected from the group consisting of

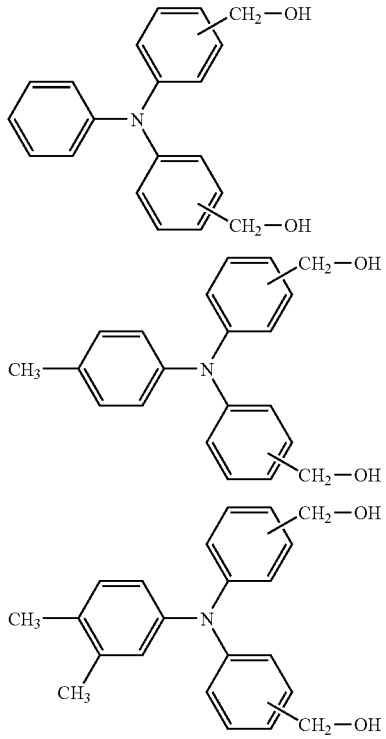

-continued

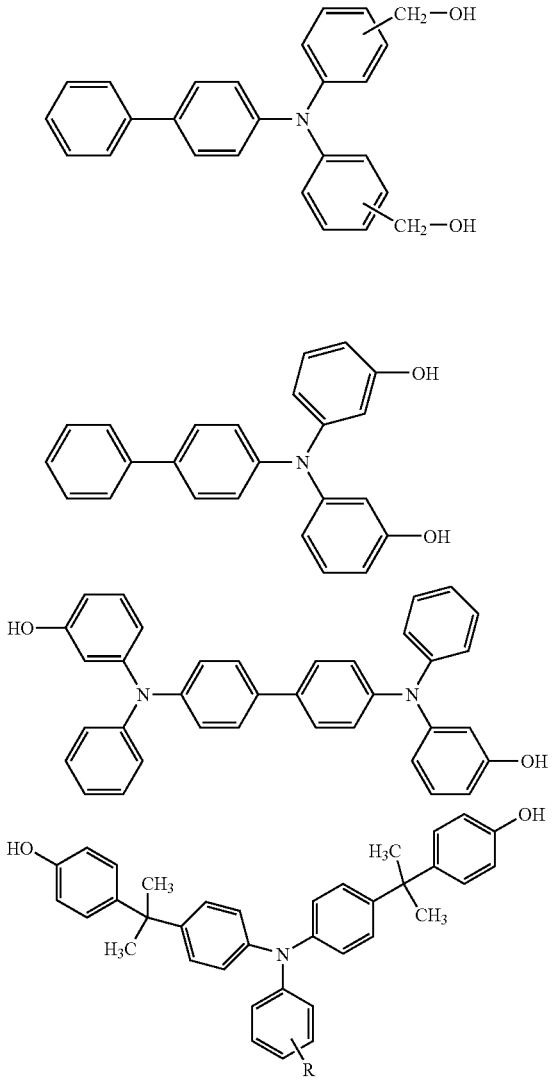

wherein R is selected from the group consisting of a hydrogen atom, an alkyl, a cyclic alkyl, an alkoxyl group, and an aryl, and mixtures thereof.

8. The electrophotographic imaging member of claim 1, wherein the composition for forming the overcoat comprises from about 25 to about 60 percent by weight of the charge transport compound, from about 5 to about 50 percent by weight of the hydroxyl group-containing polymer, and from about 10 to about 70 percent by weight of the benzoguanamine compound.

9. The electrophotographic imaging member of claim 1, wherein the composition further comprises an acid catalyst.

10. An electrographic image development device, comprising at least one charging unit, at least one exposing unit, at least one developing unit, a transfer unit, and the electrophotographic imaging member of claim 1.

11. The electrophotographic imaging member according to claim 1, wherein the hydroxyl group-containing polymer is selected from the group consisting of the polyester polyol represented by formula (1), the polyether polyol represented by formula (3), and mixtures thereof.

12. An electrophotographic imaging member comprising:

a substrate, a charge generating layer, a charge transport layer, and an overcoat layer, the overcoat layer comprising a cured film formed from a composition comprising at least a hydroxyl group-containing polymer selected from the group consisting of a polyester polyol represented by formula (1):

$$[—CH_2—R_a—CH_2]_m—[—CO_2—R_b—CO_2—]_n—[—CH_2—R_c—CH_2]_p—[—CO_2—R_d—CO_2—]_q \quad (1)$$

wherein Ra and Rc independently represent linear or branched alkyl groups having from 1 to about 20 carbon atoms and being derived from a polyol; Rb and Rd independently represent alkyl groups having from 1 to about 20 carbon atoms or aryl groups having from 6 to about 60 carbon atoms and being derived from a polycarboxylic acid, m, n, p, and q independently represent mole fractions of from 0 to 1 and n+m+p+q=1, an acrylated polyol represented by formula (2):

$$[R_t—CH_2]_t—[—CH_2—R_a—CH_2]_p—[—CH_2O—R_b—CH_2O—]_n—[—CH_2—R_c—CH_2]_p—[—CH_2O—R_d—CH_2O—]_q \quad (2)$$

wherein $R_t$ represents $CH_2CR_1CO_2$— where $R_1$ is an alkyl group of from 1 to about 20 carbon atoms or more and where t represents mole fractions of acrylated sites from 0 to 1; Ra and Rc independently represent linear alkyl or alkoxy groups or branched alkyl or alkoxy groups derived from a polyol, the alkyl or alkoxy groups having from 1 to about 20 carbon atoms; Rb and Rd independently represent alkyl or alkoxy groups, the alkyl or alkoxy groups having from 1 to about 20 carbon atoms; and m, n, p, and q independently represent mole fractions of from 0 to 1 and n+m+p+q=1, a polyether polyol represented by formula (3):

$$—[—CH_2—R_a—CH_2]_m—[—CH_2O—R_b—CH_2O—]_n—[—CH_2—R_c—CH_2]_p—[—CH_2O—R_d—CH_2O—]_q \quad (3)$$

wherein Ra and Rc independently represent linear alkyl or alkoxy groups or branched alkyl or alkoxy groups derived from a polyol, the alkyl or alkoxy groups having from 1 to about 20 carbon atoms; Rb and Rd independently represent alkyl or alkoxy groups, the alkyl or alkoxy groups having from 1 to about 20 carbon atoms, or aryl groups having from 6 to about 60 carbon atoms; and m, n, p, and q represent mole fractions of from 0 to 1 and n+m+p+q=1, and mixtures thereof, a benzoguanamine compound represented by:

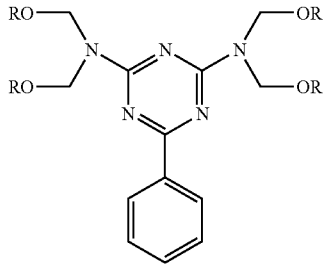

wherein R is an alkyl group having from 1 to about 10 carbon atoms, or a mixture thereof, and a charge transport compound represented by:

$$Q—[L—OH]_n$$

wherein Q represents a charge transport component, L represents a divalent linkage group, and n represents a number of from 1 to about 8.

13. The electrophotographic imaging member according to claim 12, wherein the hydroxyl group-containing polymer is selected from the group consisting of the polyester polyol represented by formula (1), the polyether polyol represented by formula (3), and mixtures thereof.

14. A process for forming an electrophotographic imaging member comprising:

providing an electrophotographic imaging member comprising a substrate, a charge generating layer, and a charge transport layer, coating thereover an overcoat a composition comprising at least a hydroxyl group-containing polymer selected from the group consisting of a polyester polyol represented by formula (1):

$$[—CH_2—R_a—CH_2]_m—[—CO_2—R_b—CO_2—]_n—[—CH_2—R_c—CH_2]_p—[—CO_2—R_d—CO_2—]_q \quad (1)$$

wherein Ra and Rc independently represent linear or branched alkyl groups having from 1 to about 20 carbon atoms and being derived from a polyol; Rb and Rd independently represent alkyl groups having from 1 to about 20 carbon atoms or aryl groups having from 6 to about 60 carbon atoms and being derived from a polycarboxylic acid, m, n, p, and q independently represent mole fractions of from 0 to 1 and n+m+p+q=1, an acrylated polyol represented by formula (2):

$$[R_t—CH_2]_t—[—CH_2—R_a—CH_2]_p—[—CH_2O—R_b—CH_2O—]_n—[—CH_2—R_c—CH_2]_p—[—CH_2O—R_d—CH_2O—]_q \quad (2)$$

wherein $R_t$ represents $CH_2CR_1CO_2$— where $R_1$ is an alkyl group of from 1 to about 20 carbon atoms or more and where t represents mole fractions of acrylated sites from 0 to 1; Ra and Rc independently represent linear alkyl or alkoxy groups or branched alkyl or alkoxy groups derived from a polyol, the alkyl or alkoxy groups having from 1 to about 20 carbon atoms; Rb and Rd independently represent alkyl or alkoxy groups, the alkyl or alkoxy groups having from 1 to about 20 carbon atoms; and m, n, p, and q independently represent mole fractions of from 0 to 1 and n+m+p+q=1, a polyether polyol represented by formula (3):

$$—[—CH_2—R_a—CH_2]_m—[—CH_2O—R_b—CH_2O—]_n—[—CH_2—R_c—CH_2]_p—[—CH_2O—R_d—CH_2O—]_q \quad (3)$$

wherein Ra and Rc independently represent linear alkyl or alkoxy groups or branched alkyl or alkoxy groups derived from a polyol, the alkyl or alkoxy groups having from 1 to about 20 carbon atoms; Rb and Rd independently represent alkyl or alkoxy groups, the alkyl or alkoxy groups having from 1 to about 20 carbon atoms, or aryl groups having from 6 to about 60 carbon atoms; and m, n, p, and q represent mole fractions of from 0 to 1 and n+m+p+q=1, and mixtures thereof, a benzoguanamine compound represented by:

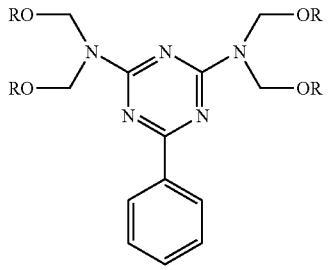

wherein R is an alkyl group having from 1 to about 10 carbon atoms, or a mixture thereof, a charge transport compound represented by:

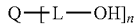

wherein Q represents a charge transport component, L represents a divalent linkage group, and n represents a number of from 1 to about 8, and an acid catalyst, followed by curing the overcoat at a temperature ranging from about 80° C. to about 160° C.

* * * * *